US008435022B2

(12) United States Patent
Burckhardt et al.

(10) Patent No.: US 8,435,022 B2
(45) Date of Patent: May 7, 2013

(54) PARTICLE SPREADER

(75) Inventors: Ralf Burckhardt, Krefeld (DE); Joerg Pudeg, Krefeld (DE); Friedhelm Schluepen, Straelen (DE); Klaus Wollny, Krefeld (DE)

(73) Assignee: Siempelkamp Maschinen-und Anlagenbau GmbH & Co. KG, Krefeld (DE)

( * ) Notice: Subject to any disclaimer, the term of this patent is extended or adjusted under 35 U.S.C. 154(b) by 770 days.

(21) Appl. No.: 12/526,054

(22) PCT Filed: Jan. 31, 2008

(86) PCT No.: PCT/EP2008/000755

§ 371 (c)(1),
(2), (4) Date: Sep. 2, 2009

(87) PCT Pub. No.: WO2008/098682

PCT Pub. Date: Aug. 21, 2008

(65) Prior Publication Data

US 2010/0092591 A1 Apr. 15, 2010

(30) Foreign Application Priority Data

Feb. 17, 2007 (DE) ..... 10 2007 007 952

(51) Int. Cl.
*B27N 3/14* (2006.01)

(52) U.S. Cl.
USPC ..... 425/83.1; 425/449

(58) Field of Classification Search ..... 425/81.1, 425/82.1, 83.1, 449
See application file for complete search history.

(56) References Cited

U.S. PATENT DOCUMENTS

| | | | | |
|---|---|---|---|---|
| 2,951,269 | A | 9/1960 | Vajda et al. | 19/155 |
| 3,252,186 | A | 5/1966 | Oja | 19/156.3 |
| 3,340,127 | A | 9/1967 | Buerkner | 156/372 |
| 4,063,858 | A * | 12/1977 | Axer et al. | 425/81.1 |
| 4,494,919 | A * | 1/1985 | Knudson et al. | 425/83.1 |
| 5,202,133 | A * | 4/1993 | Pesch et al. | 425/83.1 |
| 5,496,570 | A | 3/1996 | Mauss et al. | 425/83.1 |
| 7,627,933 | B2 * | 12/2009 | Drapela et al. | 19/296 |
| 2004/0013760 | A1 | 1/2004 | Graf et al. | 425/371 |

FOREIGN PATENT DOCUMENTS

| | | |
|---|---|---|
| DE | 10930 76 | 11/1960 |
| DE | 2165513 | 10/1972 |
| DE | 2619253 | 9/1977 |

* cited by examiner

*Primary Examiner* — James Mackey
(74) *Attorney, Agent, or Firm* — Andrew Wilford

(57) ABSTRACT

The invention relates to a dispersion installation for dispersing dispersible material on a dispersing material conveyor belt so as to form groups of material for producing wood-material boards. Said system comprises at least one dispersion material bunker for the dispersible material dispersed on the dispersing material conveyor belt, having at least one top side filling opening. A chute is connected to the filling opening via which the dispersible material can enter into the dispersion material bunker. The invention is characterized in that at least one brake cylinder device is arranged inside the chute, said brake cylinder comprising at least two rotationally driven brake cylinders.

12 Claims, 6 Drawing Sheets

PARTICLE SPREADER

CROSS REFERENCE TO RELATED APPLICATIONS

This application is the US-national stage of PCT application PCT/EP2008/000755, filed 31 Jan. 2008, published 21 Aug. 2008 as WO2008/098682, and claiming the priority of German patent application 102007007952.6 itself filed 17 Feb. 2007, whose entire disclosures are herewith incorporated by reference.

FIELD OF THE INVENTION

The invention relates to a particle spreader for strewing (glued) particles on a conveyor belt for making particle mats for the production of wood material boards or during manufacture of wood material boards.

BACKGROUND OF THE INVENTION

Such a particle spreader is provided with at least one particle supply for the particles to be strewed on the conveyor belt having at least one upper fill opening, an (overhead) chute being connected to the fill opening through which the particles enter the particle supply.

Wood material boards within the scope of the invention refers particularly to fiber boards, e.g. MDF (medium density fiber) boards. Particles refers particularly to fibers, e.g. MDF fibers. Such a particle supply is, for example, horizontally elongated and has a lower belt feeder, as well as a discharge device at the end of the belt feeder, e.g. a discharge roller front with several discharge rollers for discharging particles onto the particle conveyor belt. The conveyor belt is usually located below the particle supply. In the upper section, such a particle supply usually has an upper feeder, e.g. a drag bar feeder that feeds the particle entering the supply first upstream in the particle supply. This is to guarantee that the particle supply works according to the "first-in/first-out principle". This is particularly significant when processing glued particles, for example, glued MDF fibers, so that the fibers entering the particle supply first are also the first to be removed from it and are strewed on the conveyor belt. The belt feeder on the bottom is also called the floor supply belt. By selecting the speed of the belt feeder, the stream of particles discharged from the particle supply can be set. Filling usually takes place by using a filler that can be provided with one or more cyclones and consequently can be provided with pneumatic feeders. These cyclones are usually provided with a cell wheel at the end or on the bottom. The particles are distributed by this cell wheel and then, by interconnection of various components, are fed into the chute, so that they enter the supply.

Particle spreaders of the type described above are known in practice in various embodiments. In principle, they have proven themselves. It is of particular significance that with the help of such a particle spreader, particle mats of flawless quality and a particularly even distribution of particle can be deposited on the conveyor belt. For this reason it is known to not strew the particles from the particle supply directly onto the particle feeder, but first to a scattering head that can, for example, be designed as a dispersion roller lane and which ensures an even dispersion of the particles. Moreover, it is known in this connection to provide a particle separator between the discharge roller arrangement of the particle supply and the scattering head or the dispersion roller lane, which has two particle-separating rollers for this purpose (compare DE 43 02 850 [U.S. Pat. No. 5,496,570]).

Furthermore, an apparatus for the creation of particle mats is known in which the particles are strewed on the conveyor belt by one or more belts via a fiber distribution or particle separator device. This device for loosening or distributing fibers is located directly above the conveyor belt and has two pairs of rollers that are located above each another and that rotate in the opposite direction of interlocking elements mounted on their outer surfaces (see U.S. Pat. No. 3,252,186).

OBJECT OF THE INVENTION

The object of invention is to create a particle spreader of the type described above and that the creation of flawless particle mats possible using a simple and cost-effective design in a flawless operation.

SUMMARY OF THE INVENTION

To attain this object, the invention teaches, for a generic particle spreader of the type described at the beginning, that the chute at the fill opening (in the fiber stream) has at least one brake roller unit that has at least two rotationally driven brake rollers. The brake rollers are preferably spaced from each other by a predetermined spacing and are mounted with is essentially parallel axes, so that they do not interengage. It makes sense in the process that the brake rollers are located at approximately the same level and consequently next to each other.

The invention assumes that the quality of the particle mats made in such particle spreaders depends not only on the design of the operation of the particle supply, its discharge roller front and particularly the scattering head, but also that the way the particle supply is filled has or can have an influence on the distribution of the particles on the conveyor belt located downstream of the particle supply. Thus the invention recognizes that particle mats of high quality can be created when the particle do not enter into the supply via the chute unbraked, but when a brake roller unit with several rotating brake rollers is mounted above the inlet port of the supply and consequently of the chute. This unit not only reduces the speed of the fibers falling through the chute, but beyond that, it also ensures a swirling or distribution of the fibers so that compaction of the particles that can occur when the particle strike the supply can be avoided reliably. In this process, it is not necessary that the brake rollers interlock in a known manner per se in order to loosen potential compacted lumps of particles, but within the scope of the invention, the rollers are preferably set at a spacing from each other. In this manner, a high throughput is ensured. In spite of that, by the combined braking and distribution effect, a surprisingly uncongested and even or homogeneous filling of the supply is created, which in an especially surprising manner can have an effect on the distribution of the particle on the conveyor belt located downstream of the supply.

In a preferred further development, the brake roller device has at least two brake rollers of which one, several, or all are designed as toothed cylinders with a multiplicity of essentially radially extending teeth. The toothed rollers can have is several spike combs that are mounted on a shaft, extend the length of the roller, and are set at a predetermined angle $\alpha$ with respect to each other. Particularly advantageous for manufacturing is a preferred embodiment of the invention in which the combs can be formed by individual toothed sheet metal sheets that are, for example, each made in one piece.

It is within the scope of the invention that one, several, or all of the toothed rollers has two to ten, preferably four to eight, e.g. six individual combs, which then jointly form the toothed roller. The individual combs are then "equiangular" on the shaft or located at the same angle to each other. In an embodiment with, for example, six combs; the angle between two adjacent combs is approximately 60°.

According to a further proposal of the invention, which has particular significance, two adjacent combs are located offset by a predetermined spacing (relating to the teeth) in the longitudinal direction of the shaft. The offset between two adjacent combs can preferably be one half of the spacing of the individual teeth of a comb. This means that two adjacent combs are located quasi "at the gap," so that overall a particularly reliable braking effect and swirling of the fibers is ensured.

Further, it is advantageous when the individual combs, e.g. the toothed metal sheets, are detachably mounted on the shaft, e.g. are screwed onto the shaft or clipped onto the shaft. This is particularly advantageous for maintenance and/or cleaning purposes.

Further, the invention proposes that each individual brake roller of the brake roller unit has its own cylinder drive, that is, for example, designed as an electric motor, perhaps with a transmission. In this manner, there is in principle the possibility of driving the individual brake rollers of a brake roller unit independent of each other or at different speeds/number of revolutions. In this connection, it is particularly is advantageous when the brake rollers or two adjacent brake rollers rotate in opposite direction. But the invention also comprises embodiments in which several brake rollers or all the brake rollers are driven by a common drive perhaps by interconnecting them with one or several transmissions. In each case, it is within the scope of the invention that the brake rollers are driven at the same speed, for example, synchronously.

Particularly preferred is an embodiment of the invention in which in a chute or above the chute, a particle distribution unit is located upstream of the brake roller unit. This particle distribution unit can, for example, be an oscillating tip chute or the like, with which it is ensured that the particle is distributed by the oscillation of a channel or a pipe or the like over the cross section of the chute. Basically, oscillating tip chutes of this type are known in this context. However, the invention has recognized that by combining a known oscillating tip chute that is known per se with the brake roller unit in accordance with the invention, a particularly good filling of the supply is achieved, which has a particularly positive effect on the quality of the manufactured particle mats.

The steps in accordance with the invention lead to the manufacture of homogeneous particle mats by the even distribution of the particles on the conveyor belt which in turn affects the quality of the wood material boards that are pressed from the particle mats. This is particularly significant in connection with the manufacture of thin wood material boards, e.g. thin MDF boards, because in the manufacture of thin boards the quality of the strewed material mat is particularly important.

BRIEF DESCRIPTION OF THE DRAWING

In the following, the invention is explained in more detail with reference to a single embodiment that is shown in the drawing. Therein.

DETAILED DESCRIPTION

Figure 1:
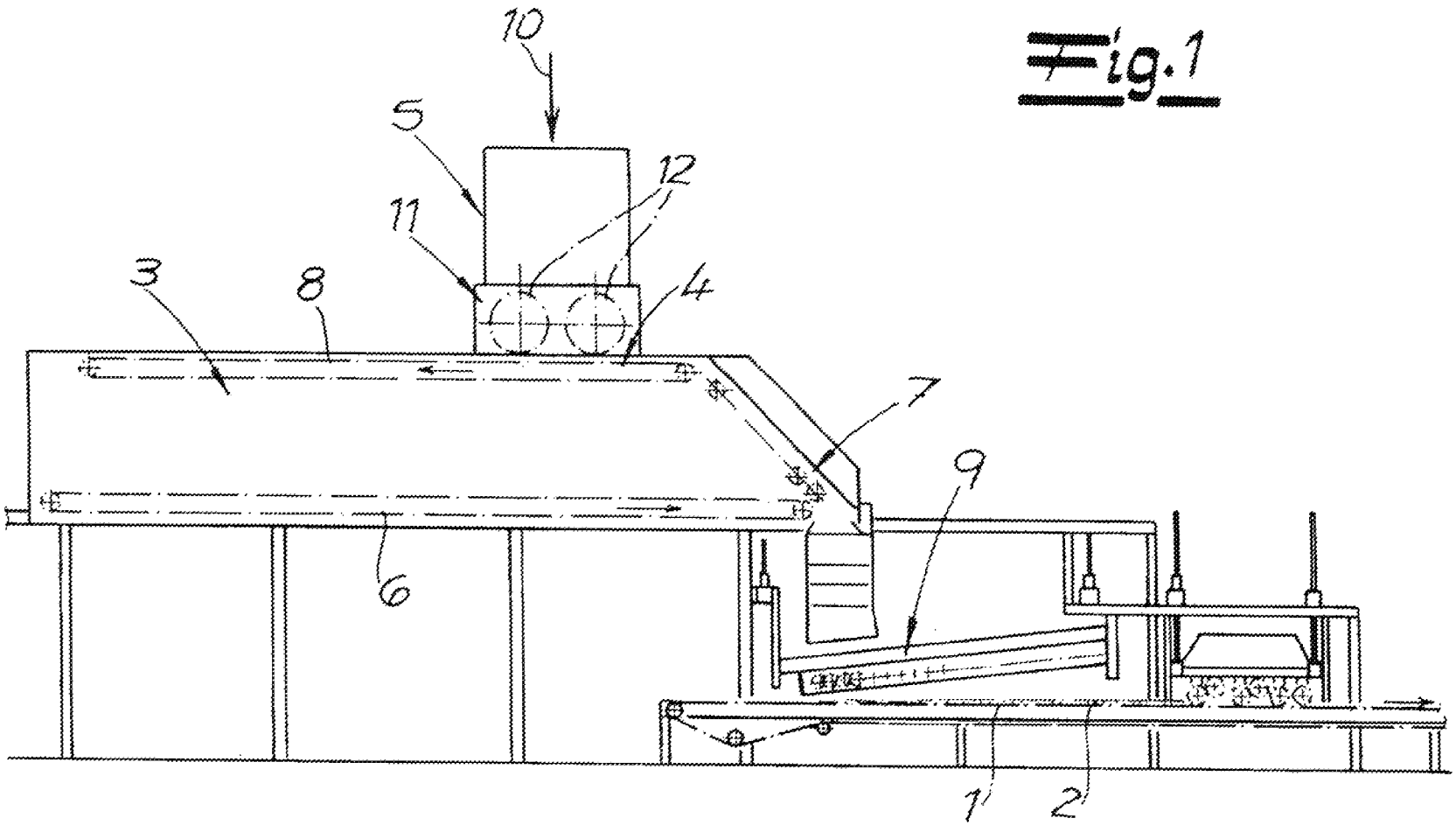
FIG. 1 is a side view of a particle spreader in accordance with the invention in a lateral view.

A particle spreader for strewing particles on a conveyor belt 1 for making particle mats 2 for the manufacture of wood material boards is shown in parts. The particles can especially be MDF fibers for the creation of MDF boards. This particle spreader has a particle supply 3 for the particles that are to be strewed as the conveyor belt 1. This particle supply 3 has a fill opening 4 on the top through which the (glued) particles are loaded into the supply 3. To this end, on top of the fill opening 4, a chute 5 is connected through which the particles enter the supply 3. In the illustrated embodiment, the particle supply 3 is designed as a horizontal supply with a belt feeder 6 on the bottom which is also called a supply bottom feeder. A discharge device is located at the end of belt feeder 6 that is designed as a discharge roller front 7 with several discharge rollers. In the upper section of the supply 3 an upper feeder is shown that is designed as a drag bar feeder 8. The working direction of the belt feeder 6 on the one hand and of the drag bar feeder 8 on the other are also indicated. It can be seen that the particles enter the area of the drag bar feeder 8 through the chute 5 and from there are first transported upstream in the supply 3. From there they go downstream to the discharge roller front 7 via the belt feeder 6 that discharges the particles from the supply 3 to the conveyor belt 1 located below the supply 3. This way, it is clear that the particles from the supply do not land on the conveyor belt 1 directly, but that via the discharge roller front 7, the particles first of all pass through the scattering head 9 that is designed as a dispersion roller lane with many dispersion rollers in the illustrated embodiment. From there, the particles reach the conveyor belt 1 and form a particle mat 2. Usually, various mat treatment devices are located downstream of the scattering head 9, for example, a leveling unit and/or a prepress before the particle mat 2 enters the hot press.

In addition FIG. 1 shows that the particles enter the chute via a particle feeder 10. It can have one or more cyclones with cell wheels and/or other feeders, worms or the like. No details are shown in the figures.

Figure 2:
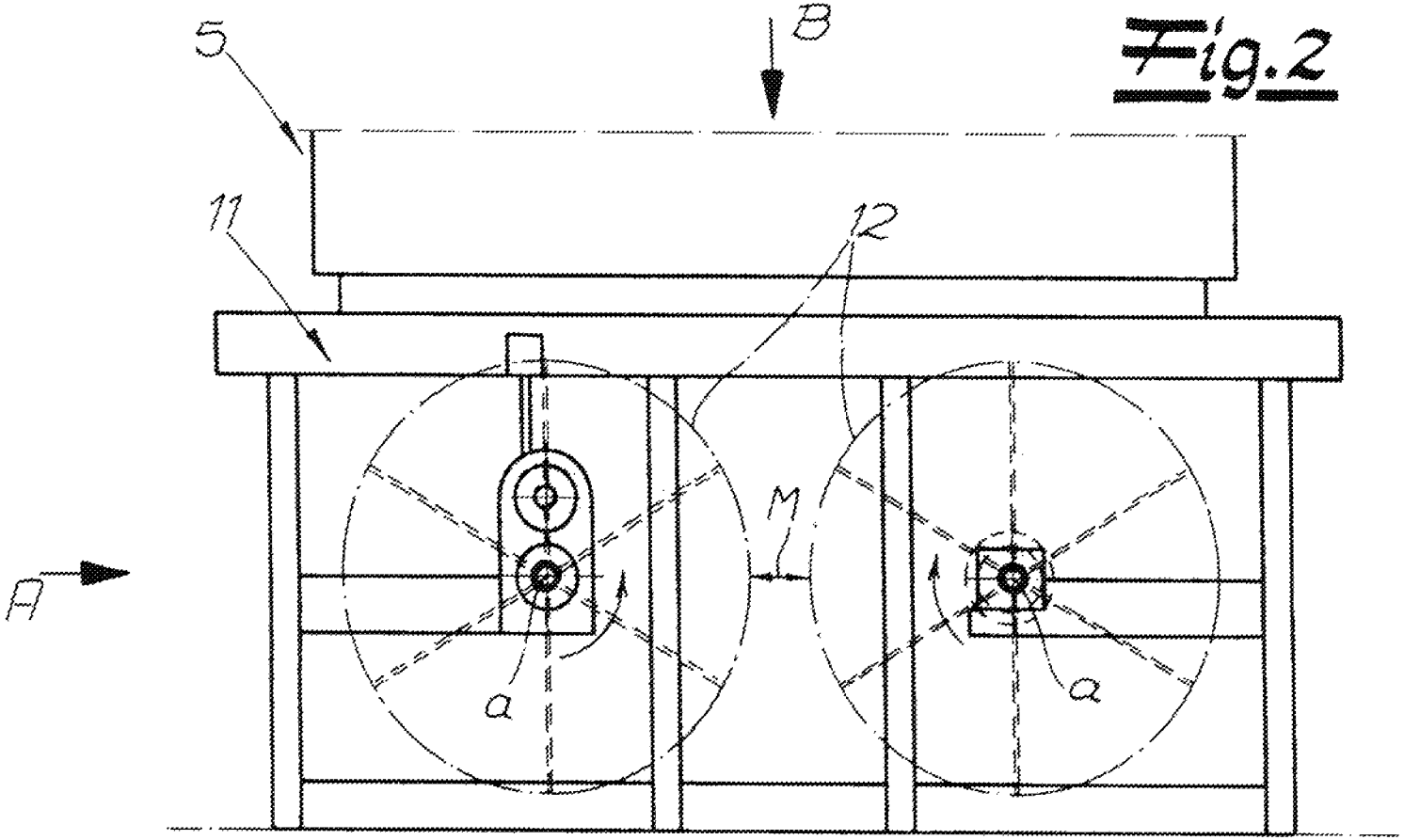
FIG. 2 is a cross section through the apparatus in accordance with FIG. 1.

In accordance with the invention as shown in FIG. 2, a brake roller unit 11 with two rotationally driven brake rollers 12 is provided in the chute 5, and consequently in the fiber stream. The brake rollers 12 are spaced from each other by a predetermined spacing M, and are basically positioned parallel to each other on respective axes a. The spacing M between the brake rollers 12 in this case is the spacing M indicated in FIG. 2 of the "orbits" of the brake rollers. FIG. 2 indicates that the brake rollers 12 rotate in opposite directions. To that extent, however, it is only an example.

Figure 4:
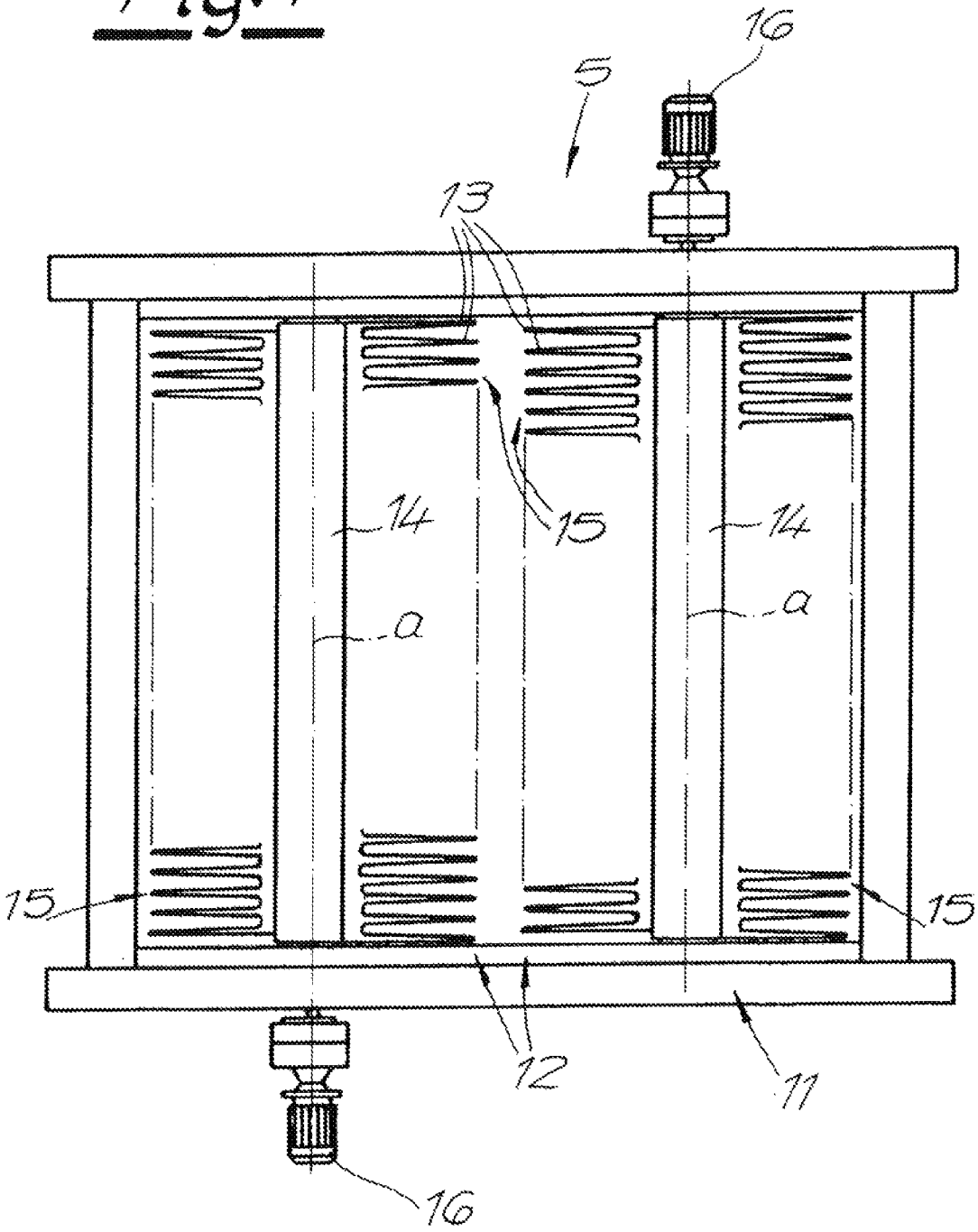
FIG. 4 is a view of the apparatus of FIG. 2 from the direction of arrow B of FIG. 2.
Figure 5:
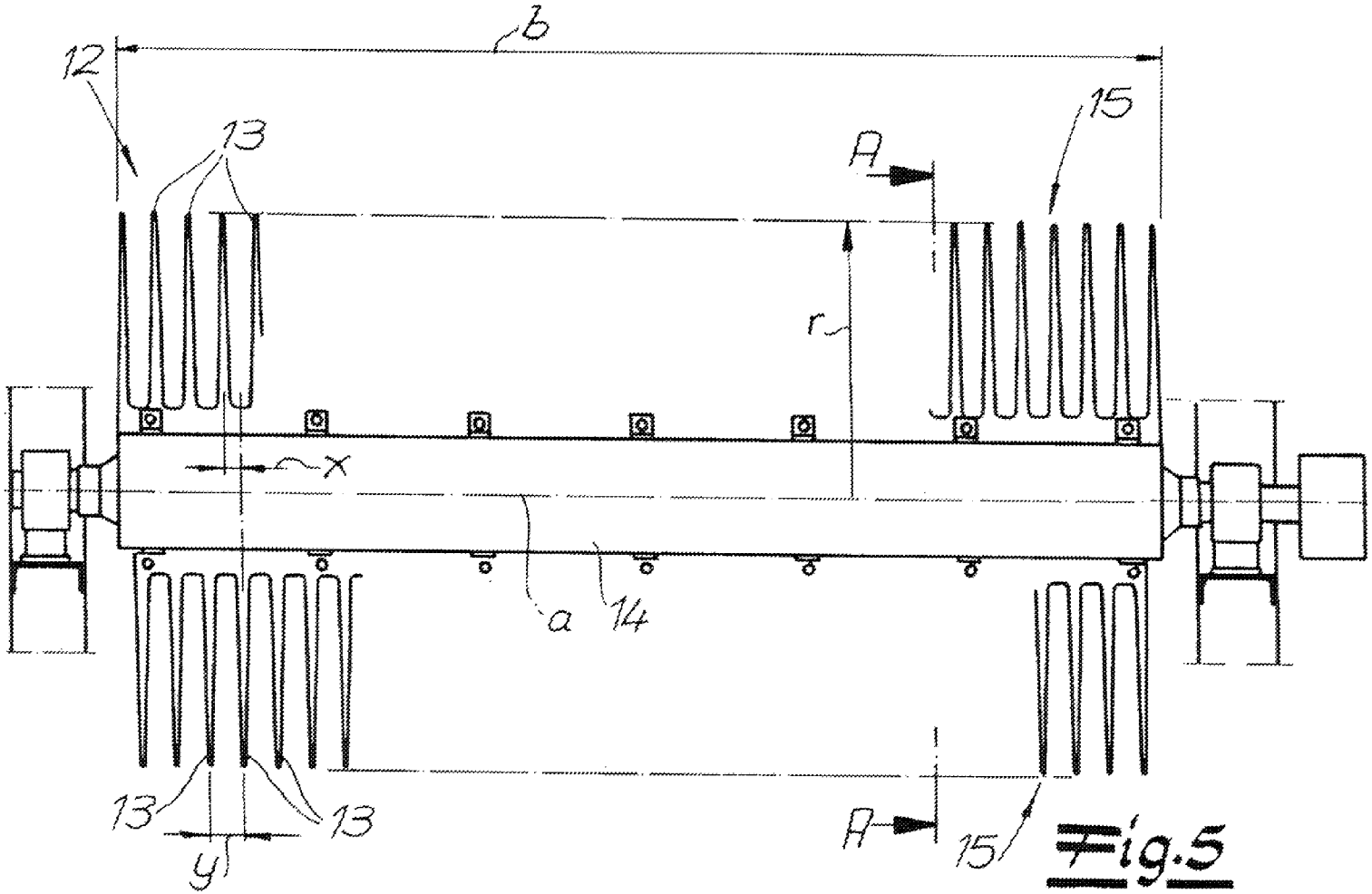
FIG. 5 shows a toothed roller of the apparatus as in FIG. 4
Figure 6:
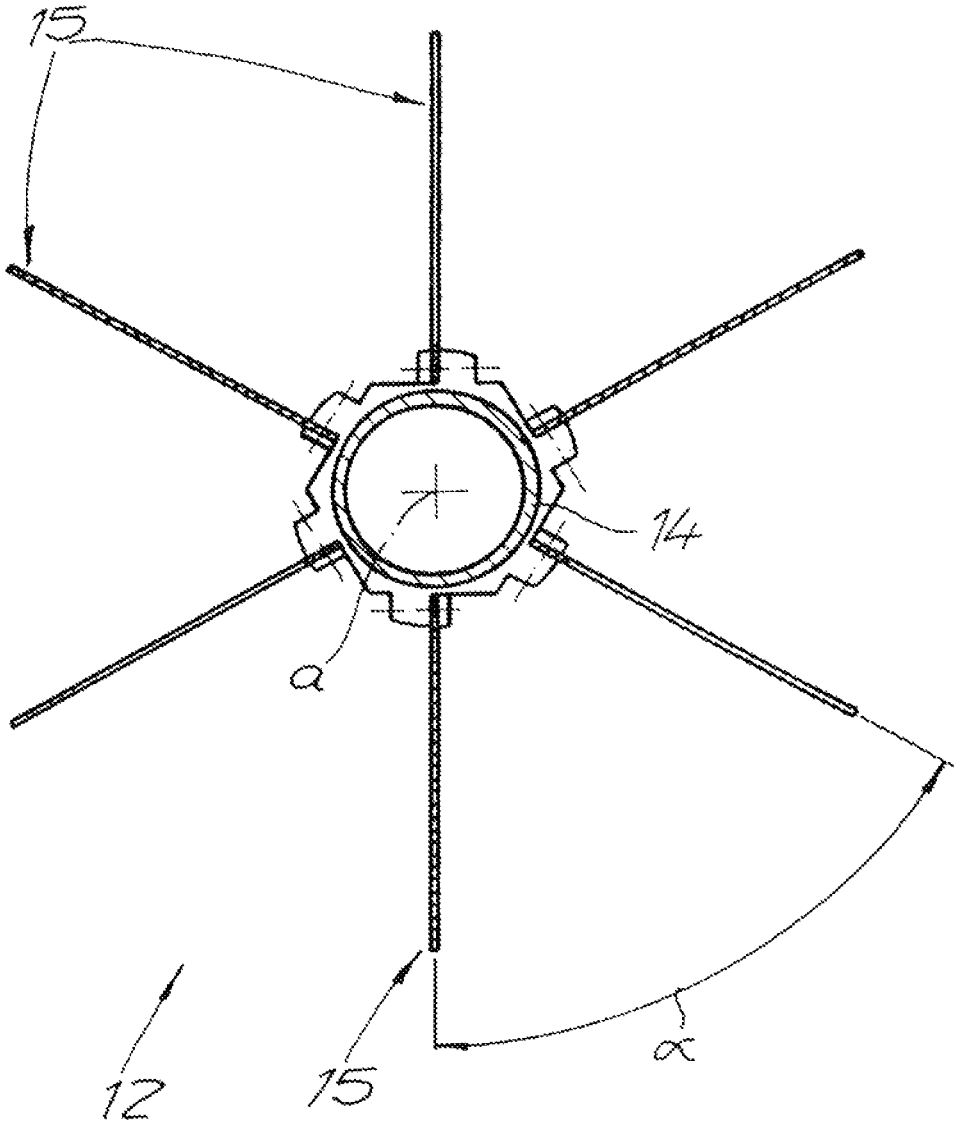
FIG. 6 is a section through the apparatus along line A-A of FIG. 5.

In particular in FIGS. 4, 5, and 6, it can be seen that the brake rollers 12 each have a multiplicity of pointed teeth 13 that extend substantially radially of the respective axis a. To this end, each toothed roller 12 has several combs 15 mounted on a shaft 14 and extending the entire axial length of the respective roller 12. FIG. 6 shows that the combs 15 extend at a predetermined angle $\alpha$ to each other. In the illustrated embodiment, six combs 15 are provided set at an identical angle to one another, the angle α in the illustrated embodiment being equal to 60°.

At the same time, each one of these combs 15 is designed as a toothed metal sheet in one piece. The individual toothed metal sheets 15 are screwed to the shaft 14 and are consequently detachably mounted on the shaft 14.

Furthermore, FIGS. 5 and 6 show that adjacent teeth 13 of the combs 15 are staggered to each other. Here, staggered means in relation to the individual teeth 13, offset in the axial direction of the shaft 14. The offset x between two adjacent toothed metal sheets thereby amounts to approximately one half of the spacing y of two adjacent teeth 13 of a toothed metal sheet 15 in the illustrated embodiment, creating the "on gap" arrangement shown in FIG. 5.

Figure 3:
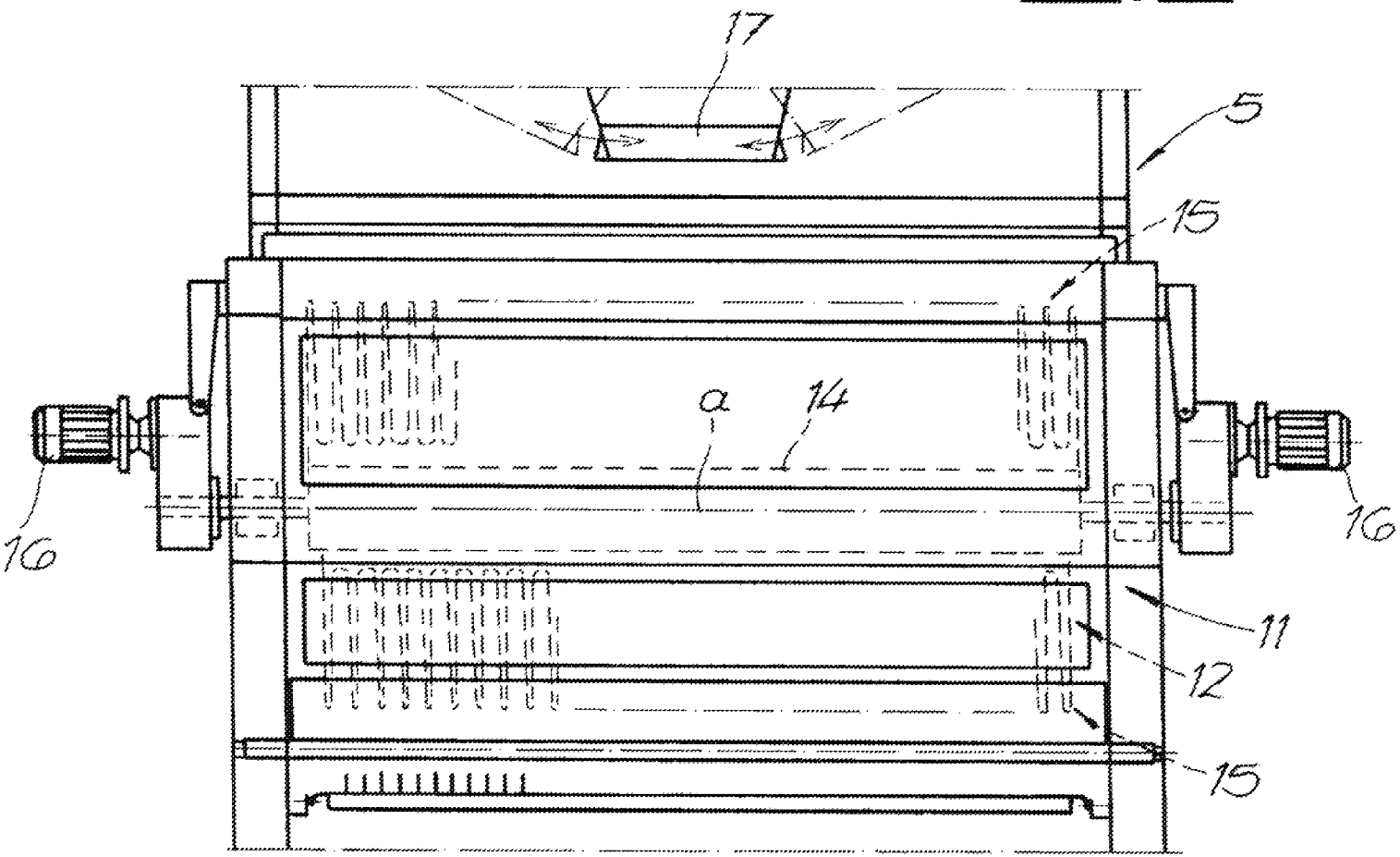
FIG. 3 is a view of the apparatus of FIG. 2 from the direction of arrow A of FIG. 2.

FIGS. 3 and 4 show that each toothed roller 12 has a dedicated electrical drive 16.

Finally, FIGS. 1 to 3 show that the chute 5 holds not only the toothed rollers 12 in accordance with the invention, but also above the toothed rollers 12 an oscillating tip chute 17 known per se which can be designed as a displaceable outlet or a displaceable piece of pipe and as a result of an oscillating motion ensures good distribution of particles across the chute 5. The interaction of this oscillating tip chute 17 with the brake rollers 12 according to the invention leads to particularly good results.

The toothed rollers 12 extends approximately over the entire transverse width of the chute 5. This corresponds approximately to the width of the particle supply 3.

A brake roller 12 as shown in the figures can have a length b of, for example, 2.5 to 3 m, and a radius r of, for example, 50 to 80 cm, for example, 60 to 70 cm. Each individual toothed metal sheet 15 has, for example, 20 to 40 teeth, for example, 25 to 35 teeth that can have a center spacing y of 5 to 15 cm, for example, 8 to 10 cm.

Preferred directions of rotation are illustrated by the two arrows in FIG. 2. The rotation speed of one or both rollers can be 5 to 100 rotations per minute, preferably 6 to 60 rotations per minute, for example, 30 rotations per minute.

The invention claimed is:

1. A particle spreader for strewing particles onto a conveyor belt for making a particle mat for the manufacture of wood material boards, the spreader comprising:

a particle supply above the conveyor belt for the particles to be strewed on the conveyor belt and having at least one upper fill opening, a horizontally extending belt feeder underneath the fill opening, and discharge rollers at an end of the belt feeder;

a scattering head underneath the discharge rollers and above the conveyor belt;

a chute opening downward at the fill opening and through which the particles enter the particle supply; and two rotationally driven brake rollers in the chute, the chute with its brake rollers, the supply with its belt feeder and discharge rollers, and the scattering head being relatively oriented such that particles entering the chute pass down in the chute between the brake rollers to drop onto the belt feeder and then pass out through the discharge rollers to the scattering head that strews the particles on the conveyor belt to form the mat.

2. The particle spreader according to claim 1 wherein the brake rollers are spaced from each other by a predetermined spacing and located at the same level with essentially parallel axes.

3. The particle spreader according to claim 1 wherein the brake rollers each have a plurality of essentially radially extending teeth.

4. The particle spreader according to claim 3 wherein the toothed brake rollers are each provided with several combs carried on a respective shaft, extending essentially over the length of the respective shaft, and extending at a predetermined angle to each other.

5. The particle spreader according to claim 4 wherein the combs are one-piece toothed metal sheets.

6. The particle spreader according to claim 4 wherein one of the toothed brake rollers is provided with two to ten of the combs.

7. The particle spreader according to claim 4 wherein adjacent combs of one of the toothed brake rollers are set at an essentially identical angle to each other.

8. The particle spreader according to claim 4 wherein two adjacent combs are axially staggered relative to each other by a predetermined spacing in the longitudinal direction of the respective shaft.

9. The particle spreader according to claim 8 wherein an axial offset between the teeth of two adjacent combs amounts to approximately one half of a spacing of two adjacent teeth of a comb.

10. The particle spreader according to claim 4 wherein the combs are detachably mounted on the respective shaft.

11. The particle spreader according to claim 1 wherein each brake roller is provided with a respective drive.

12. The particle spreader according to claim 1, further comprising a particle distribution unit upstream of the brake rollers in or above the chute.

* * * * *